United States Patent [19]

Scholle

[11] 4,120,134

[45] Oct. 17, 1978

[54] APPARATUS FOR AND METHOD OF FILLING FLEXIBLE CONTAINERS

[75] Inventor: William R. Scholle, Corona del Mar, Calif.

[73] Assignee: Scholle Corporation, Northlake, Ill.

[21] Appl. No.: 815,533

[22] Filed: Jul. 5, 1977

[51] Int. Cl.[2] ..... B65B 3/00; B65B 31/00

[52] U.S. Cl. ..... 53/434; 53/469; 53/470; 53/512; 53/268; 53/281; 141/114; 141/313

[58] Field of Search ..... 53/14, 29, 37, 22 A, 53/22 B, 112 B, 268–275, 281–283, 300, 381 A, 187, 266; 141/10, 157, 164, 166, 176, 313–317, 114, 281, 282

[56] References Cited

U.S. PATENT DOCUMENTS

| | | | |
|---|---|---|---|
| 3,011,293 | 12/1961 | Rado | 53/37 X |
| 3,087,518 | 4/1963 | Scholle | 141/317 |
| 3,262,247 | 7/1966 | Scholle | 53/300 X |
| 3,299,606 | 1/1967 | Weikert | 53/37 |
| 3,377,775 | 4/1968 | Mattimoe et al. | 53/266 X |
| 3,427,646 | 2/1969 | Scholle | 53/37 |
| 3,447,281 | 6/1969 | Buford et al. | 53/268 X |
| 3,483,666 | 12/1969 | Harmes et al. | 53/268 X |
| 3,516,220 | 6/1970 | Buford et al. | 53/268 |
| 3,699,746 | 10/1972 | Titchenal et al. | 53/187 |
| 3,868,891 | 3/1975 | Parish | 93/8 W |

*Primary Examiner*—Robert Louis Spruill
*Attorney, Agent, or Firm*—Gary, Juettner & Pyle

[57] ABSTRACT

Apparatus for and method of filling flexible containers, each having a spout adapted to be closed by a separable cap, characterized in that the containers are connected together seriatim in a continuous row and are fed automatically one after another to a filling and capping station, rather than being hand fed one at a time to the station. This results in increased speed of operation and decreased labor costs. In one embodiment the containers are moved seriatim to the filling station by an intermittently operated conveyor. In another embodiment the weight of the filled containers pulls succeeding empty containers to the filling and capping station. At the station, between the filling and capping steps, the container is manipulated so as to seal off the spout and prevent entry of foreign matter to the container during the time between removal of the filling nozzle from the spout and application of the cap to the filled container.

33 Claims, 19 Drawing Figures

APPARATUS FOR AND METHOD OF FILLING FLEXIBLE CONTAINERS

BACKGROUND OF THE INVENTION

The present invention relates to an apparatus for and a method of filling flexible containers, characterized by the steps of providing a plurality of containers connected in continuous web form and by moving the containers seriatim to a filling station whereat the containers automatically are filled.

Flexible bags comprised of a thermoplastic material, such as polyethylene, are well adapted to contain fluid materials such as milk, water, fruit juices, wine, chemicals and the like. Customarily the bag is disposed in a paperboard or other relatively rigid container for support, and is provided with a spout through which the contents may be dispensed. To maintain the spout closed and the contents free from contamination until such time as it is desired to dispense the contents, the outer end of the spout is equipped with a cap.

Such bags conventionally are separately and individually filled through the spouts thereof, thereby requiring machine attendants to hand feed the bags into proper association with the filling head of a filling machine. Where the contents are consummable, care must at all times be taken to maintain the same in a sanitary condition and free from contamination. A particular problem arises due to the in-rush of air between the filling and capping operations resulting in the presence of an oxidizing agent and possibly other contaminants in the head space of the bag.

OBJECTS OF THE INVENTION

An object of the present invention is to provide an improved apparatus for and method of filling flexible containers automatically and without contamination. Another object of the invention is to provide an apparatus for and a method of automatically filling flexible containers wherein the containers are connected in continuous web form and are automatically fed or moved seriatim to a filling station without need for manual handling.

A further object of the invention is to provide such an apparatus and method for filling containers having spouts, wherein a closure or cap is automatically applied to the spout after the container has been filled through the spout.

A still further object of the invention is to provide an apparatus and method wherein the spout of the container is automatically and conveniently sealed off after being filled, whereby to exclude entry of air or any other foreign substance between the filling and capping steps.

Yet another object of the invention is to provide such an apparatus and method wherein, in one embodiment, the containers connected in continuous web form are moved seriatim to the filling station by an intermittently operated conveyor.

Still another object of the invention is to provide such an apparatus and method wherein, in another embodiment, the containers connected in continuous web form are moved seriatim to the filling station by the weight of one or more filled containers.

SUMMARY OF THE INVENTION

In accordance with the present invention, a method is provided for filling containers each having a spout communicating therewith adapted to be closed at its outer open end by a separable cap, comprising the steps of providing a plurality of containers connected together seriatim in a continuous row; moving the row of containers intermittently automatically to advance the containers seriatim to a filling station; and at said filling station, holding the spout on each container with said outer end thereof substantially upright, introducing contents through the outer end of the spout to fill the respective container, placing the cap on the spout to close the same, and releasing the spout to accommodate the next increment of movement of the row of containers.

The invention also includes a method for filling such containers comprising the steps of inserting a filling nozzle into the spout and introducing contents into the container to fill the container, moving an internal wall of the container into overlying engagement with the inner end of the spout to seal off the spout and exclude entry of air and other foreign matter, and thereafter removing the filling nozzle from the spout and applying a cap to the outer end of the spout to seal the filled container.

The apparatus of the invention is particularly adapted for filling containers as above described which are connected together in a continuous row, and includes means for incrementally advancing the row of containers seriatim to a filling station, and filling means at the station for sequentially filling each container with contents through the spout, and then placing a cap on the spout.

In a preferred embodiment, the apparatus has a spout holder for releasably holding the spout of each container at the filling station. The filling means includes a nozzle connectable with the spout to fill the container therethrough, and a capping mechanism which may either apply to the spout a cap from a source of supply of caps, or remove from the spout a previously applied cap and then after filling reapply the cap on the spout. Means may if desired be provided for drawing a vacuum through said nozzle to void the container of gas prior to or after filling. After the container has been filled and the spout is capped, said spout holder releases the spout of the just-filled container so that the row of containers may be advanced to bring a succeeding empty container to the filling station.

In one embodiment, one or more filled containers are carried on a conveyor which is intermittently operated to move the row of containers seriatim to the filling station. In another embodiment, one or more filled containers are carried on a downwardly sloping trackway whereby the weight of the filled container or containers advances the row to bring the next succeeding empty container to said filling station.

After the filled container has completed its web or row moving function, it may be severed from the row to provide an individual filled container.

A particular feature of the apparatus of the invention resides in the provision of a pressure plate which underlies the filling nozzle to aid in supporting the container being filled, and which upon completion of the filling cycle is adapted to be moved toward the nozzle thereby to move an internal wall of the container into overlying relationship with the inner end of the spout to seal off the spout and to exclude entry of air and other foreign matter into the container until the cap has been applied.

Other objects, advantages and features of the invention, including its details of construction, arrangement of parts, method of operation and economies thereof, will be appreciated from a consideration of the following detailed description when taken in conjunction with the accompanying drawings.

DETAILED DESCRIPTION

The present invention provides a method of and apparatus for automatically, efficiently and conveniently filling successive flexible containers, for example flexible bags comprised of a thermoplastic material such as polyethylene and the like, by connecting the same together, end to end, seriatim, in the form of a continuous web. The web of bags is conveniently formed on conventional bag making machinery, omitting therefrom the step of severing the bags into individual units.

Each bag has a spout sealed thereto about an aperture therein, and the open end of the spout normally is closed by a separable cap. The cap may initially be affixed to the spout at the bag making machine, or may subsequently be applied to the spout after filling of the bag. In the following description of the preferred embodiment of the apparatus of the invention, the cap is assumed to have been applied to the spout before filling, i.e., the web of bags fed to the machine has caps on the spouts thereof.

Empty bags from a continuous web supply are incrementally advanced seriatim to a filling station of the apparatus whereat means are provided for filling successive bags through their spouts. The means for filling includes means for holding the spout of a bag at the filling station, and means for sequentially separating the cap from the spout to open the spout, filling the bag with contents through the uncapped spout, and replacing the cap on the spout. The spout then is released and the web again is advanced to move the filled bag from the filling station and to bring the next succeeding empty bag thereto.

In the preferred embodiment, means are provided for drawing a vacuum through the filling mechanism so that, if necessary, any gases or atmosphere may be withdrawn from the bag prior to and/or after filling of the same, so that the contents are maintained in a sanitary condition free from contamination.

In one embodiment the bags connected in continuous web form are carried on a conveyor, and the conveyor is intermittently operated to advance the bags seriatim to the filling station. In another embodiment, a filled bag is supported on a downwardly sloping trackway so that, upon release of the spout of the bag at the filling station, the filled bag moves down the trackway under its own weight to pull the next succeeding connected empty bag to the filling station. The operation of the apparatus is automatic, whereby maximum number of bags may conveniently, quickly and economically be filled with minimal manual labor and/or supervision.

Figure 1:
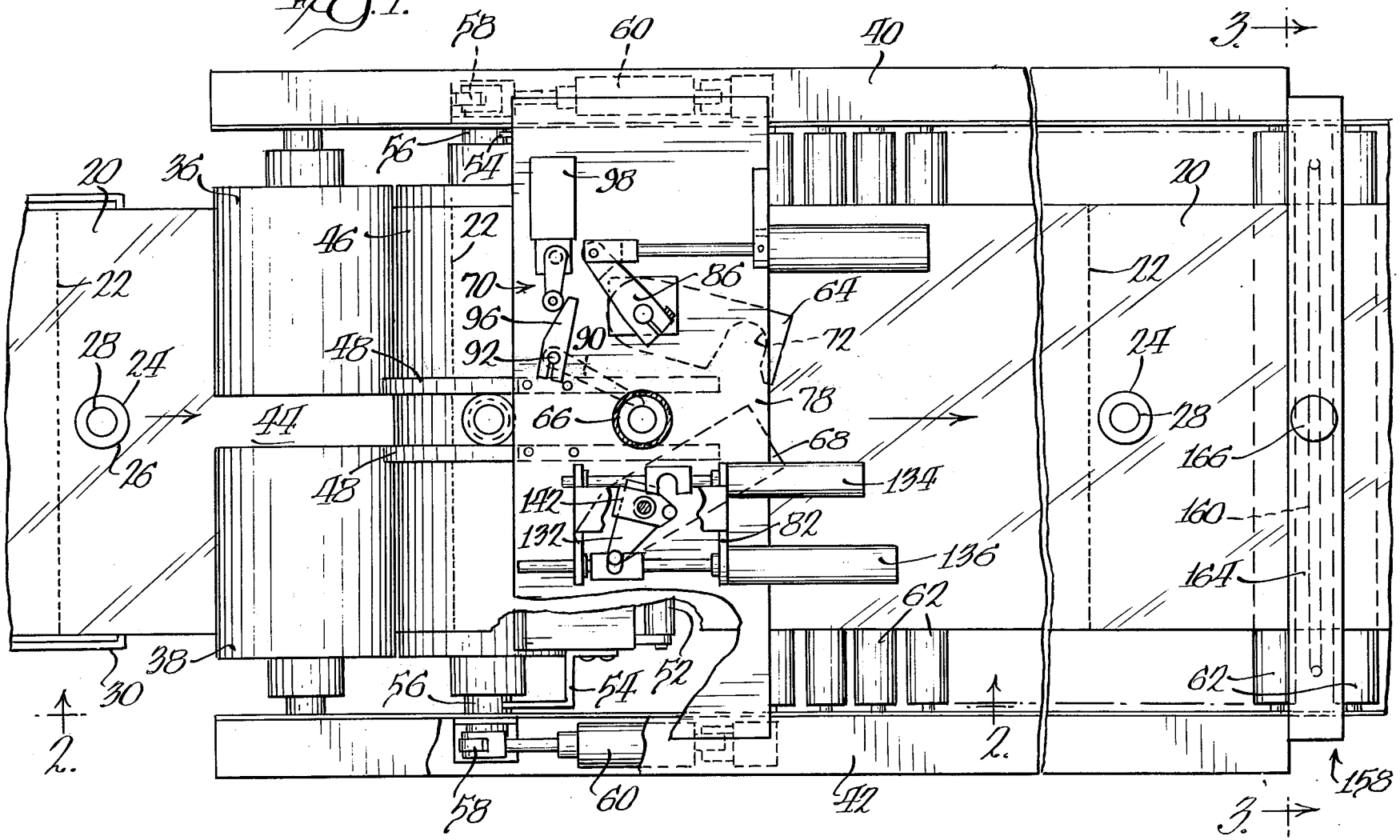
FIG. 1 is a fragmentary top plan view of a preferred embodiment of the apparatus of the invention for sequentially filling flexible containers connected in continuous web form.
Figure 2:
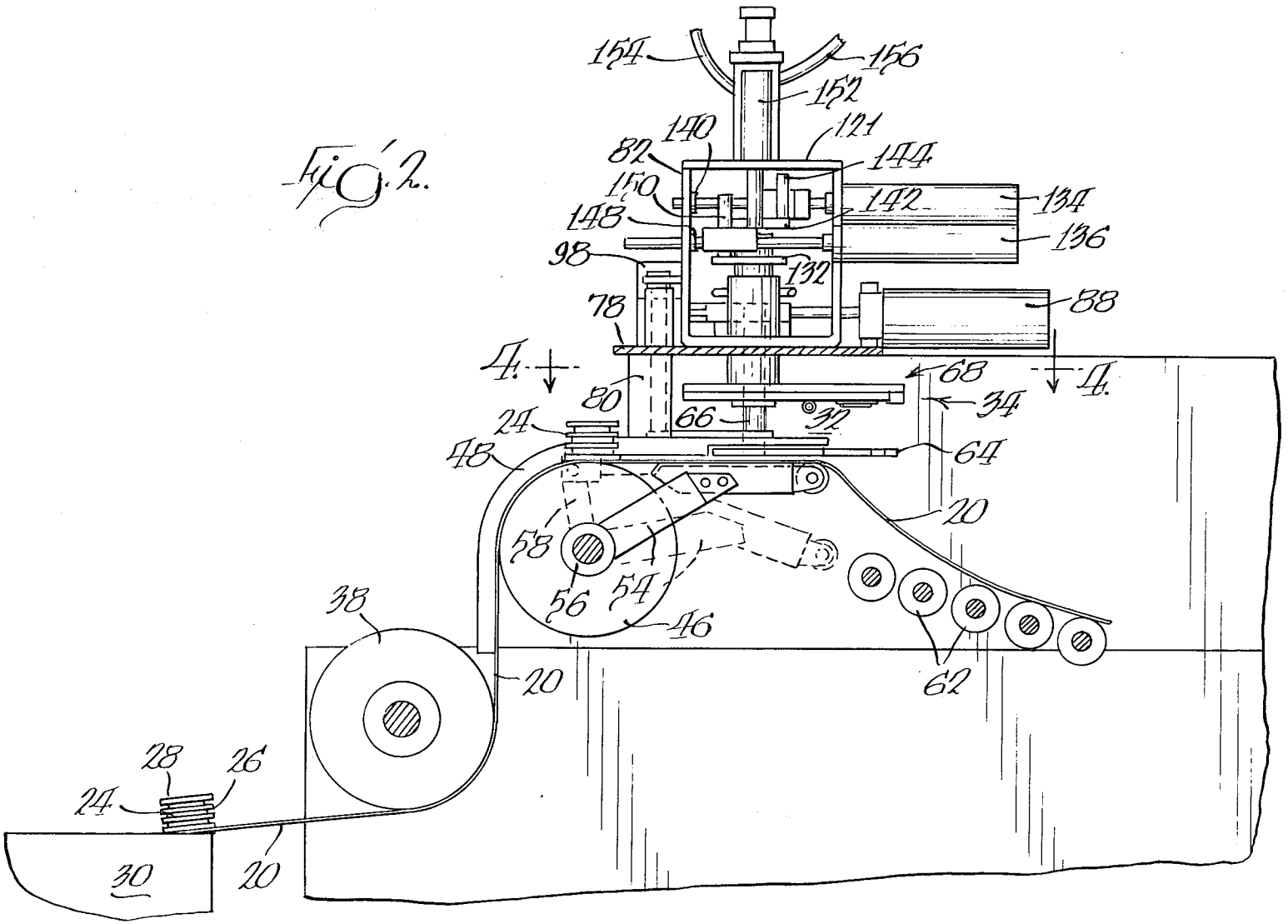
FIG. 2 is a partial side elevation view taken substantially along line 2—2 of FIG. 1, showing a bag filling station of the apparatus.

Referring to the drawings, which illustrate salient features of preferred embodiments of the invention, and in particular to FIGS. 1 and 2, the container filling apparatus receives, advances and automatically fills successive flexible containers connected in continuous web form, such as flexible bags 20 of thermoplastic material. The bags are joined together, as indicated at 22, and each has a spout 24 sealed thereto and communicating with an aperture therein. The spouts are formed with annular ribs 26 defining annular recesses therebetween, and a separable cap 28 is provided on each spout to close the otherwise open outer end thereof. As above stated, and as will be appreciated, the caps may be applied to the spouts either before or after filling. A supply of bags may conveniently be maintained in a carton or bin 30 for withdrawal therefrom by the filling apparatus.

The apparatus has a filling station 32 whereat the bags are filled with product or contents by a filling means, indicated generally at 34. To support and guide the bags to the filling station, and to orient the bag spouts thereat for being received by the filling means, a pair of bag supporting and spout centering rollers 36 and 38 are coaxially journaled in side frame members 40 and 42 and define between inner facing ends thereof a space 44 of a width sufficient to receive a spout. A roller 46 is rotatably jounaled in the side frame members above and forward of the rollers 36 and 38, and a pair of guide rails 48, aligned with and having a spacing substantially equal to the width of the space 44, extend from a position adjacent to the space, peripherally around a portion of the roller 36, and to the filling station 32. Bags 20 drawn from the box 30 to the filling station extend in a run around lower surfaces of the rollers 36 and 38 and over the upper surface of the roller 46, with the spout of each bag being toward the trailing end thereof. Consequently, as the bags move to the filling station the spouts first are received and oriented in the space 44 between the centering rollers, and then move to between the guide rails 48, whereby the spout of each bag arriving at the filling station is oriented to be engaged by the filling means 34, as will be described.

To support each bag at the filling station for engagement with the filling means, and later for manipulation to exclude entry of excess air of other contaminants from the filled bag, a table 50 having a roller 52 on a forward end thereof is supported beneath the station by a pair of arms 54 extended bedween opposite sides of the table and associated sleeves 56 around opposite ends of the shaft of the roller 46. The outer end of each sleeve is connected with an associated one of a pair of line arms 58, each of which in turn is coupled with the plunger of an associated one of a pair of cylinders 60. With the cylinders operated as shown to extend their plungers, the table 50 is horizontal and immediately beneath the station 32. Upon operation of the cylinders to retract their plungers, the table is rotated clockwise to a downward sloping position as shown in phantom lines in FIG. 2. A plurality of rollers 62 are journaled between the side frame members 40 and 42 generally in alignment with the table 50 in its downward position, and form a trackway which slopes downwardly away from the filling station. As well be seen, in one embodiment of the invention the weight of each successively filled bag moves the same down the trackway to pull or advance the succeeding empty bag to the station.

Referring also to FIGS. 4–8, the filling means 34 includes a spout holder 64, a nozzle 66 and a capper assembly and a switch means indicated generally at 68 and 70, respectively. The spout holder normally is positioned to intercept and hold the spout of a bag moved to the filling station, and the switch means senses entry of the spout into the holder to initiate operation of the apparatus to fill the bag. The filling nozzle and the capper assembly then operate sequentially to uncap the spout (if the cap was previously applied), fill the bag with product through the spout, and cap the spout, all while the spout is being held.

Figure 4:
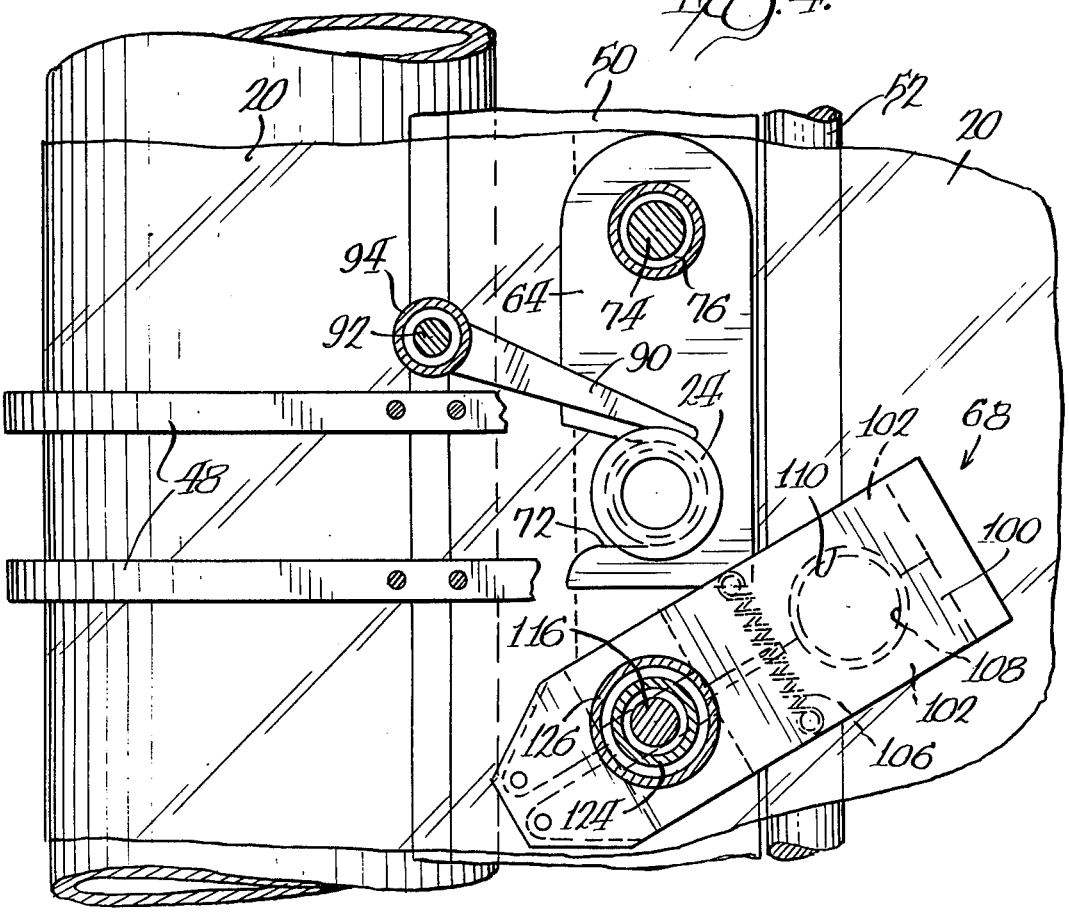
FIG. 4 is a fragmentary top plan view, partly in cross-section, taken substantially along line 4—4 of FIG. 2, and illustrates the orientation of a spout holder and capping mechanism at the filling station at the time when a spout on a container is first moved thereto.
Figure 5:
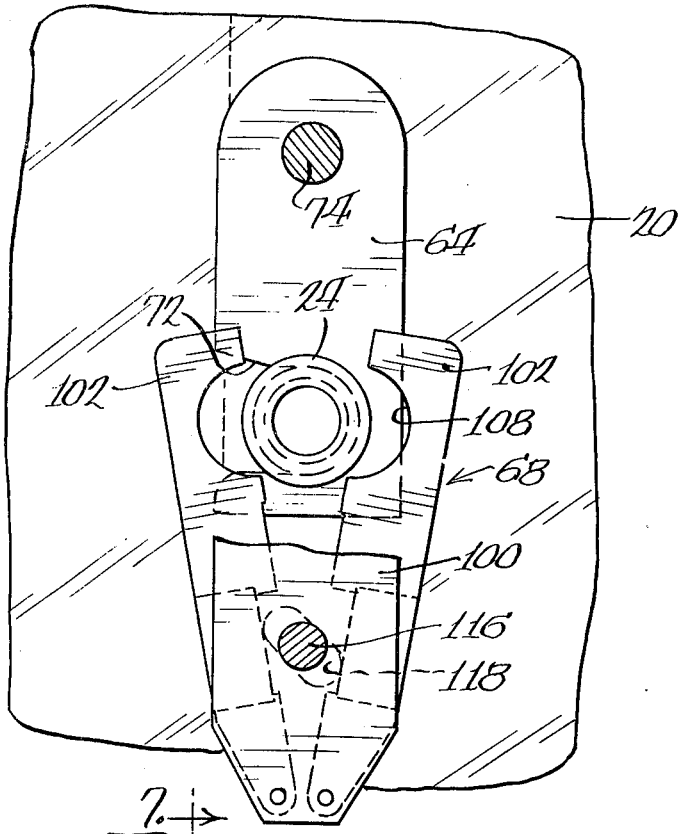
FIG. 5 is a fragmentary top plan view, partly in cross-section, illustrating a capping mechanism adapted for removing a cap previously applied to the spout of an empty container, the mechanism being illustrated with the jaws thereof in an open position for receiving the cap.

The spout holder 64 comprises a generally flat plate having a side opening 72 toward one end thereof which is configured to receive and closely surround a spout within the area between a pair of ridges thereon. An opposite end of the holder is fastened to a shaft 74 which extends upward, within a sleeve 76, through both a plate 78 supported above and between the side frame members 40 and 42 by posts 80, and through the lower side of a U-shaped bracket 82 mounted on the plate 78. The shaft is rotatable within the sleeve in bushings 84, and a yoke 86 is secured around the upper end of the shaft. Means for rotating the shaft, and therethrough the spout holder, is provided by a cylinder 88 fastened on the plate 78 and connected by its plunger with the yoke, whereby when the cylinder is operated to its condition to retract the plunger the spout holder is rotated, as shown in FIG. 4, to intersect the path of travel of a bag spout and to receive and hold the spout within the opening 72 as it exits from between the guide rails 48. The guide rails thus orient the spout and direct the same into the spout holder. To release the held spout, the cylinder later is operated to its other condition to extend the plunger to rotate the spout holder away from and out of engagement with the spout and out of the path of travel thereof, as is shown in FIGS. 1 and 2, so that the spout is free to move therepast.

While an empty bag is moved to the filling station, the spout holder is positioned to intercept the spout thereof. To sense when actual engagement of the spout by the spout holder occurs, the switch means 70 includes a sensor finger 90 connected at one of its ends to a shaft 92 which extends upwardly within a sleeve 94 through the plate 78. An opposite end of the sensing finger is positioned to be engaged and moved by a spout entering the holder, and an actuator arm 96 for operating a switch 98 is fastened to an upper end of the shaft. The arrangement is such that when a spout enters the opening 72 in the spout holder the sensing finger is rotated counterclockwise as viewed from above to operate the switch 98 with the actuating arm 96. Operation of the switch indicates that an empty bag is at the filling station and that its spout is engaged with the spout holder, and initiates the next succeeding stages of operation of the apparatus in the filling of the bag.

With the spout held by the spout holder, the capper assembly 68 then removes the cap from the spout to permit the bag to be filled therethrough and, after flling is completed, replaces the cap on the spout. As best shown in FIGS. 4–8, the capper assembly includes an upper plate 100 and a pair of symmetrical cap gripping jaws 102 rotatably mounted to a lower side of the plate by a pair of fasteners 104. Means are provided, such as a spring 106, for urging the jaws toward a closed position, and the jaws have side openings therein which, when the jaws are closed, define an aperture through the jaws having a lower lip portion 108 of a first diameter and an upper section 110 of a second and greater diameter. The arrangement is such that the diameter and thickness of the upper portion is sufficient to accommodate therein a headed portion 112 of a spout cap 28, while the lower lip portion extends under and around the head of the cap. Accordingly, when the jaws are opened and positioned around the head of a cap, and then closed, the head is gripped within the aperture formed by the jaws. Upward movement of the capper assembly then pulls the cap from the spout to open the outer end thereof. To support the free ends of the jaws when a cap is pulled from a spout, a generally L-shaped bracket 114 fastened to the plate 100 adjacent the free ends of the jaws extends under the jaws thereat.

Means for supportng and operating the capper assembly 68 to close and open the jaws to grip and release caps, to elevate and lower the assembly to uncap and recap spouts, and to rotate the assembly to a position remote from the uncapped spout to clear a path for the nozzle 66 thereto, includes a shaft 116 having an elongate cam 118 formed at a lower end thereof. The shaft is fastened at an upper end to a plunger of a cyclinder 120 for vertical movement therewith. The cyclinder is mounted on a plate 121 across the top of the bracket 82, and the cam is positioned within an opening formed between facing surfaces of cam followers or bearing blocks 122 on respective ones of the jaws 102, whereby upon rotation of the shaft 116 the cam acts on the bearing blocks to open and to close the jaws. Between the cam and the cylinder the shaft extends through the plate 78 and the bracket 82 within an inner sleeve 124 and an outer sleeve 126. The inner sleeve is secured at its lowermost end within a passage through the capper plate 100, and the shaft 116 is rotatable therein in a pair of bearings 128. The outer sleeve 126 is fastened about its periphery within passages formed through the plate 78 and the bracket 82, and the inner sleeve 124 is both vertically reciprocable and rotatable therein in a pair of bearings 130. The capper jaws may thus be opened and closed by rotation of the shaft 116, and the entire capper assembly 68 may be vertically elevated and lowered and/or rotated by like movement of the inner sleeve 124 within the outer sleeve 126.

Figure 7:
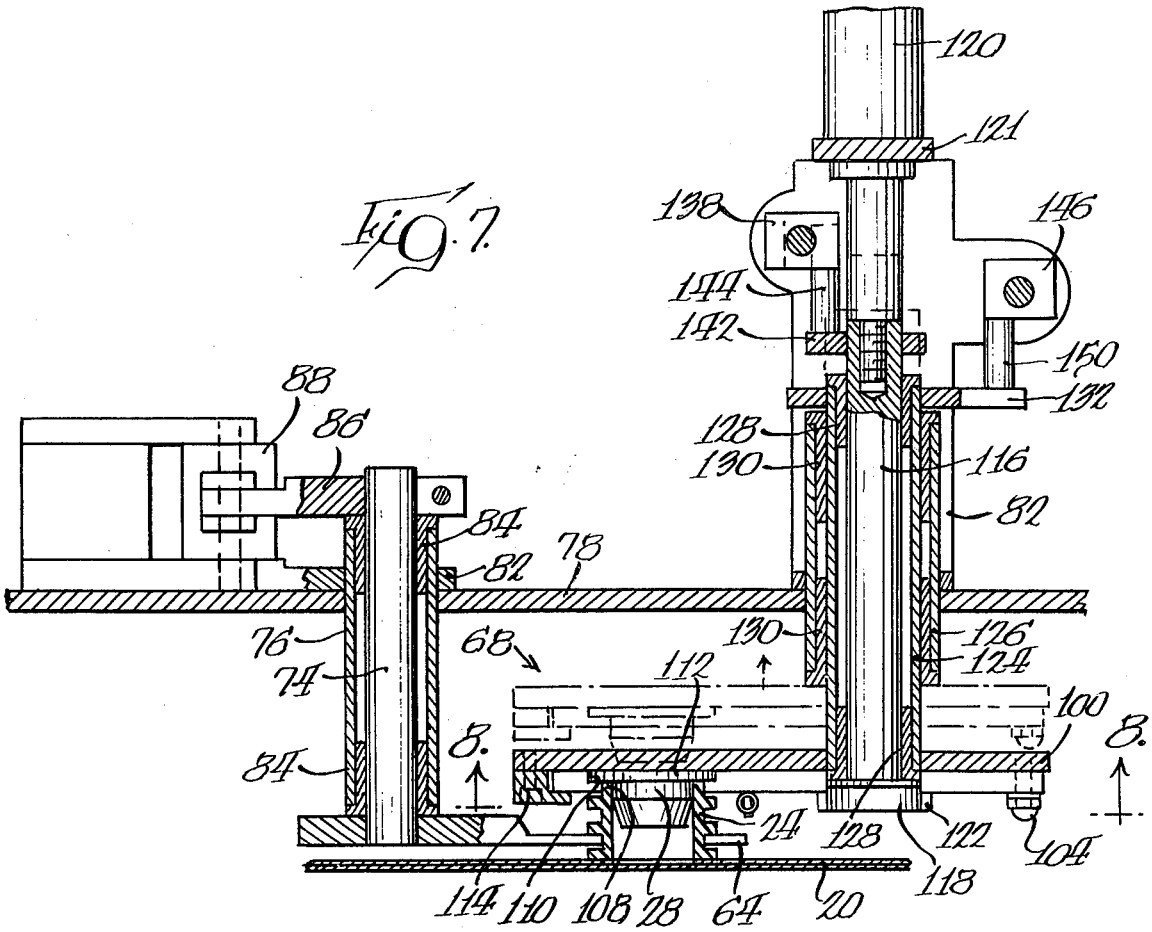
FIG. 7 is a fragmentary, cross-sectional, side elevation view taken substantially along line 7—7 of FIG. 6, illustrating additional features of the spout holding and capping mechanism.
Figure 8:
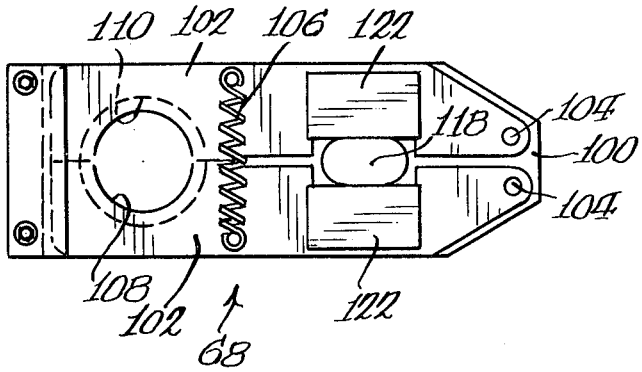
FIG. 8 is taken substantially along line 8—8 of FIG. 7, and is a bottom plan view of the jaws of the capping mechanism.

Referring to FIG. 7, the means for raising and lowering the capper assembly includes the cylinder 120 which is actuable to raise and lower the shaft 116 and therethrough the inner sleeve 124 with the outer sleeve 126. The lowermost position of the capper assembly is shown in solid lines, and is determined by engagement of a yoke 132, secured around the upper end of the inner sleeve 124, with an upper lip portion of the upper bearing 130. With the capper at its lowermost position and rotated to be above a spout held by the spout holder 64, the jaws are aligned for gripping the head of the cap in the spout. The uppermost position of the capper assembly, as shown in phantom lines, is determined by engagement of the plate 100 with a lower lip portion of the lower bearing 130, and is of sufficient height above an uncapped spout so that the bottom of a cap held thereby is above the uppermost portion of the spout, whereby the capper assembly may freely be rotated without engagement of the cap with the spout.

Figure 6:
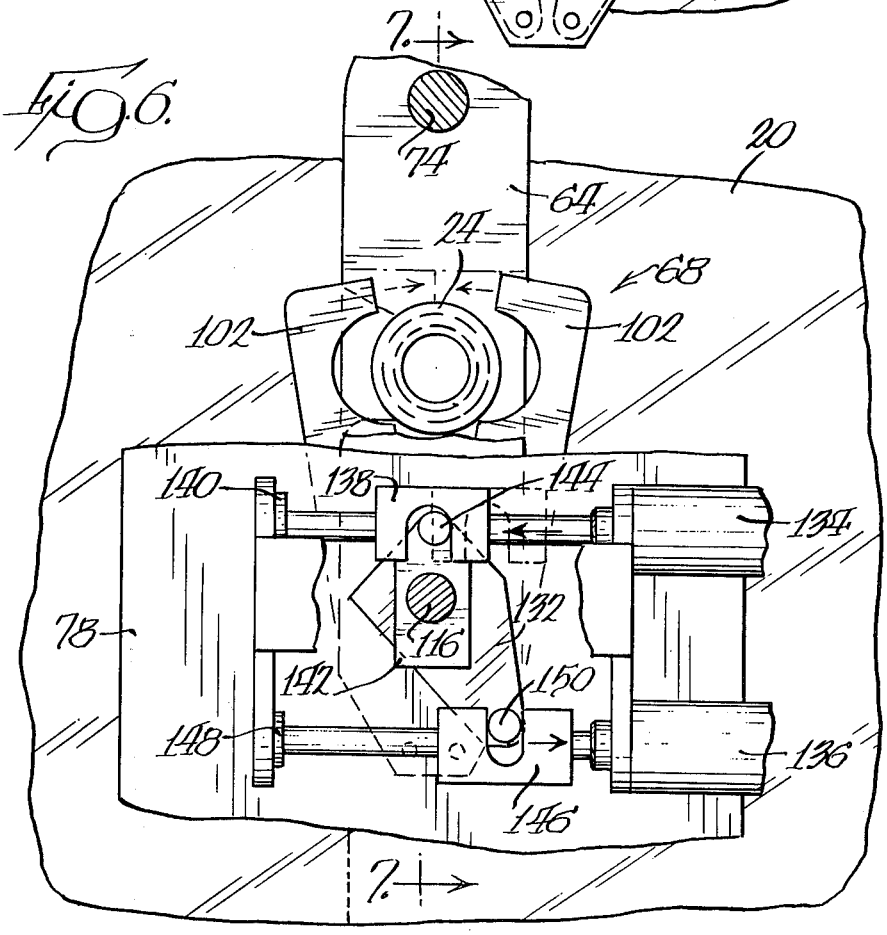
FIG. 6 is a top plan view similar to FIG. 5, additionally showing apparatus for rotating the capping mechanism to a position above the spout cap and for opening and closing the jaws thereof.

Referring also to FIG. 6, means for rotating the shaft 116 within the sleeve 124 to open and close the jaws of the capper assembly, and for rotating the sleeve 124 to rotate the entire capper assembly, includes a pair of cylinders 134 and 136 mounted on a side portion of the bracket 82. The cylinder 134 is for rotating the shaft 116, and has a slide block 138 intermediately disposed along a plunger thereof, an outer end of the plunger being slidably supported within a guide 140. A yoke 142 is fastened about an upper portion of the shaft 116, and has an upstanding post 144 which extends within a slotted opening in the slide block 138. Operation of the cylinder 134 to reciprocate the slide block thus rotates the shaft 116, and thereby the cam 118. The cylinder 136 is for rotating the entire capper assembly, and has a slide block 146 intermediately disposed along a plunger thereof, an outer end of the plunger being slidably supported within a guide 148. An upstanding post 150 on the yoke 132 extends within a slotted opening in the slide block 146, whereby operation of the cylinder 136 to reciprocate slide block 146 imparts rotational movement to the inner sleeve 124, and therethrough to the capper assembly.

In its operation to uncap and cap spouts, during the time that an empty bag is being advanced to the filling station the capper assembly 68 is maintained above the spout holder 64 with the jaws thereof in an open position. This is accomplished by retracting the plunger of the cylinder 120 to hold the capper assembly in its elevated position, by retracting the plunger of the cylinder 136 to rotate the assembly above the spout holder, and by extending the plunger of the cylinder 134 to rotate the cam to open the jaws. Upon the spout of a bag entering the spout holder, the sensing finger 90 is engaged by the spout to actuate the switch means to initiate succeeding stages of operation. The plunger of the cylinder 120 is then extended to lower the capper assembly onto the head of the spout cap, and the plunger of the cylinder 134 is retracted to close the capper jaws around the head of the cap to grip the cap. The cylinder 120 then elevates the capper assembly to pull the cap out of the spout and to elevate the cap to the position above the spout. The plunger of the cylinder 136 is then extended to rotate the capper assembly to the position remote from the spout. This clears a path to the spout for the filling nozzle positioned thereabove. It is noted that during the time that the cylinder 136 rotates the capper assembly, the plunger of the cylinder 134 simultaneously is further retracted to prevent relative motion between the capper assembly and the cam 118 so that the jaws remain closed.

To replace the spout cap the above described cycle of operation is reversed. Specifically, the plunger of the cylinder 136 is retracted while the plunger of the cylinder 134 simultaneously is extended to rotate the capper assembly to position the cap above the spout while maintaining the capper jaws closed. The cylinder 120 then lowers the capper assembly and reinserts the cap into the spout, whereupon the plunger of the cylinder 134 is further extended to open the jaws and release the cap. The cylinder 120 then elevates the capper assembly to its position above the spout holder in preparation for uncapping and recapping the spout of a subsequent bag advanced to the filling station 32.

The bags are filled through the uncapped openings in the spouts. Prior to considering the mechanisms for filling the bags, it should be noted that as each succeeding bag is moved to the filling station, upon its spout being held by the spout holder 64 the table 50, which is then in the upper horizontal position, is rotated by the cylinders 60 to the downwardly sloping position as shown in phantom lines in FIG. 2. Since in its upper position the table would close or seal the lower end of the spout or the opening between the spout and the bag, downward movement of the table away from the spout is necessary to open the same so that product may be introduced into the bag. Further, such downward movement enables the table, after the bag is filled and prior to recapping, to advantageously be moved upward to cause the lower wall of the bag to seal off the spout and exclude contaminants, as will be described.

Means for filling the bags includes a cylinder assembly 152 connected through a line 154 with a source of vacuum and through a line 156 with a supply of product. The nozzle 66 is operatively and fluidically connected with the cylinder assembly, and except during filling of a bag is in an elevated position with its lowermost end above the capper assembly. Upon a spout being uncapped and the capper assembly moved to the position remote therefrom, the cylinder assembly 152 lowers the nozzle into sealed engagement with the spout about the opening therein. As an optional step, to insure sanitary and unimpeded filling of the bag, any air or other gases in the bag may first be withdrawn by applying vacuum from the line 154 to the nozzle. Flow of product from the line 156 is then effected through the nozzle to fill the bag. After a predetermined amount of product is introduced into the bag, the flow is stopped.

During filling of the bag, the major portion thereof rests on the downward sloping trackway formed by the rollers 62 and the table 50, and the spout is toward the upper end of the bag. After the bag is filled, the upper portion of the bag in the area of the spout may (if not initially evacuated) contain a volume of air or other gases, some of which may have been introduced into the bag along with product. These may if desired be withdrawn by again drawing a vacuum through the nozzle.

Desirably, substantially all of any such atmosphere should be removed and excluded from the head space of the bag prior to recapping both to minimize the overall volume of the bag and, more importantly, to prevent oxidation and/or contamination of the product in the bag.

According to the invention, atmospheric gases and/or contaminants are excluded from the filled bag by moving the table or plate 50 upwardly to cause the internal surface of the lower wall of the bag to overlie and seal off the inner end of the spout and to hold the lower wall in such sealing position while the nozzle is removed from the spout and the cap is applied to the spout to seal the bag closed.

Alternatively, but less desirably, the nozzle may be removed from the spout and the table 50 then returned to its upper position. In this event, as the table moves upward, it squeezes and compresses the upper end of the bag to expel any atmosphere that may have entered. Then, upon reaching its uppermost position, the table again seals the opening between the spout and the bag to prevent reentry of atmosphere into the bag. The capper assembly 68 then recaps the spout to seal the bag, and the spout holder 64 is rotated away from and out of the path of the spout to release the bag for movement away from the filling station.

Figure 2A:
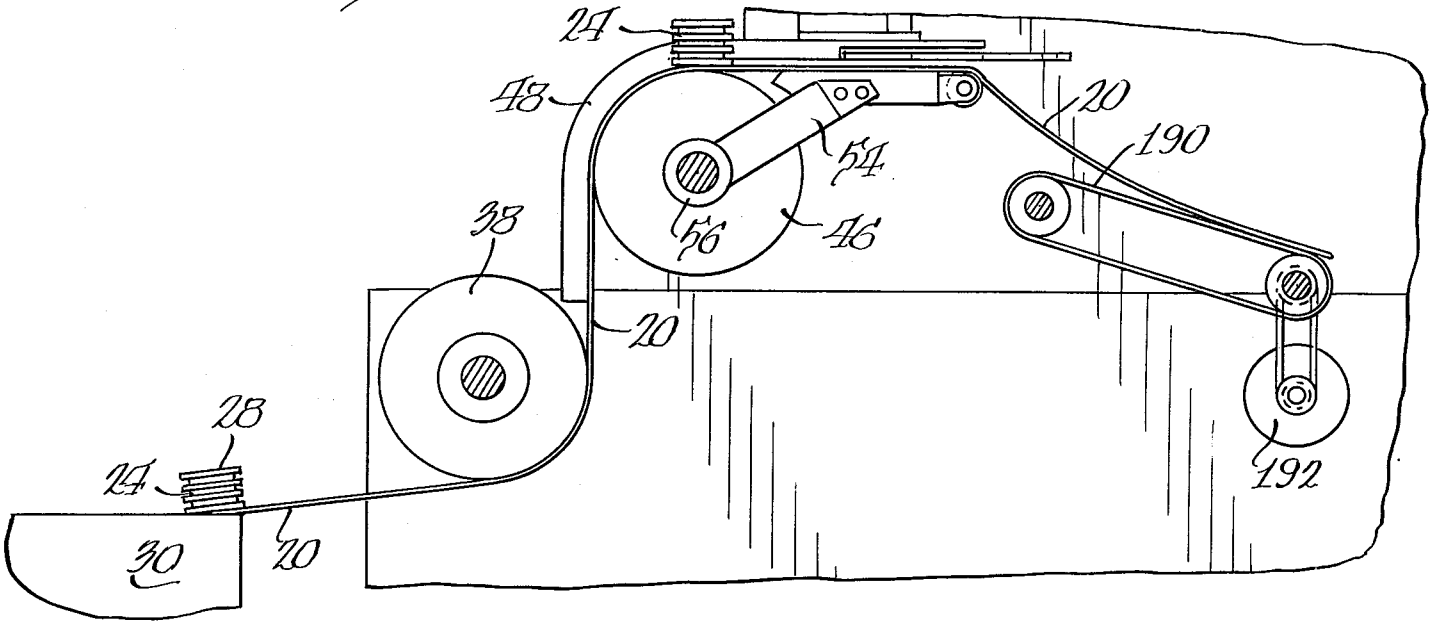
FIG. 2*a* is a partial side elevation view of an alternate embodiment of a conveyor portion of the apparatus shown in FIG. 2.

With the filled bag supported on the downward sloping trackway formed by the rollers 62, upon release of the spout, the bag moves under its weight along the trackway away from the filling station. In another embodiment of the invention, and as shown in FIG. 2*a*, a conveyor 190 is provided in place of the rollers 62, and is operated by a motor 192 upon each succeeding bag being filled to move the bag away from the filling station. In either case, movement of the filled bag from the filling station pulls or advances the next succeeding empty bag to the station and moves the spout thereof into the spout holder, whereupon movement of the bags is arrested and the above described filling operation is again repeated.

Figure 3:
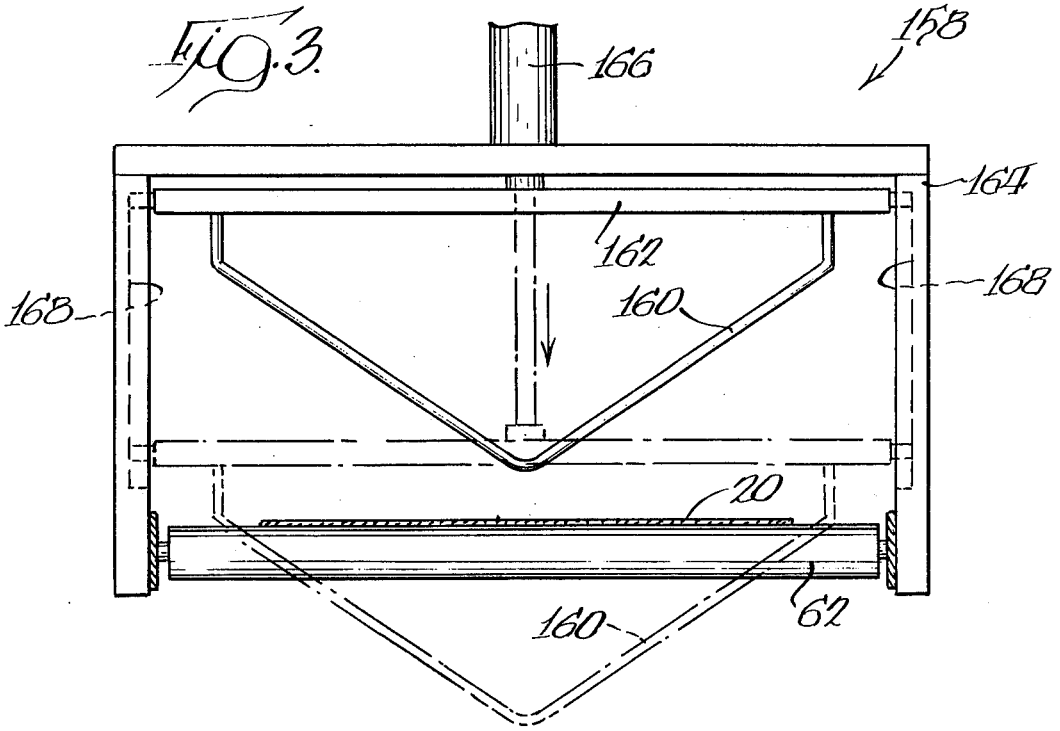
FIG. 3 is an end elevation view taken substantially along line 3—3 of FIG. 1, and illustrates a mechanism for separating a filled container from a succeeding container.

Upon the next succeeding empty bag being moved to the filling station, the previously filled bag is separated therefrom along the line 22. This is accomplished at a severing station, indicated generally at 158, positioned along the apparatus to be above the line when the succeeding empty bag is fully advanced to the filling station. As shown in FIG. 3, the means for separating the bags includes a V-shaped severing bar 160 depending downwardly from a horizontal member 162. A U-shaped frame 164 is mounted to opposite side frame members 40 and 42, and a cylinder 166 is carried atop the frame for moving the severing bar in vertical directions. Opposite ends of the member 162 are received within guide channels 168 formed in facing sides of uprights portions of the frame, so that upon downward movement the severing bar is guided to engage the web of bags and separate the filled bag from the web; the bar in its severing movement passing between an adjacent pair of rollers 62 as shown in phantom lines in FIG. 3. As each successively filled bag is severed from the web of bags, the same may be deposited in a carton or other container, or may otherwise be removed from the apparatus in any suitable manner.

Figure 9:
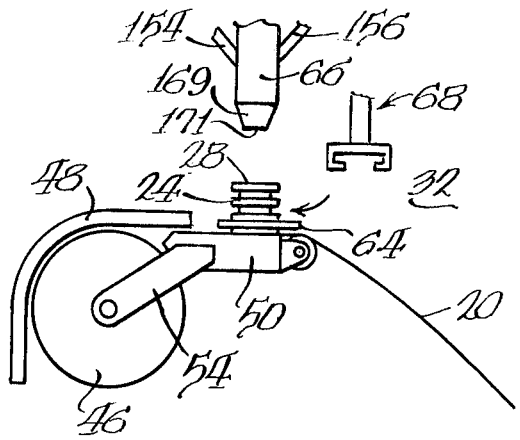
FIGS. 9–13 successively illustrate the sequential stages of the mechanisms at the filling station in effecting filling of a container in accordance with one embodiment of the invention.

FIGS. 9 through 13 illustrate sequential stages of operation of the apparatus in filling successive plastic bags connected in continuous web form. FIG. 9 shows the initial condition of the apparatus when a spout 24 of a bag 20 first enters and is held by the spout holder 64. At this time, the spout holder is rotated to a position to intercept the path of travel of the spout, the capping apparatus 68 is elevated to a position above the spout, and the nozzle 66 is in its upper position. With the spout held, the major portion of the bag extends beyond the filling station and rests on the downwardly sloping trackway formed either by the rollers 62 or by a conveyor, neither being shown in FIGS. 9 through 13.

Figure 10:
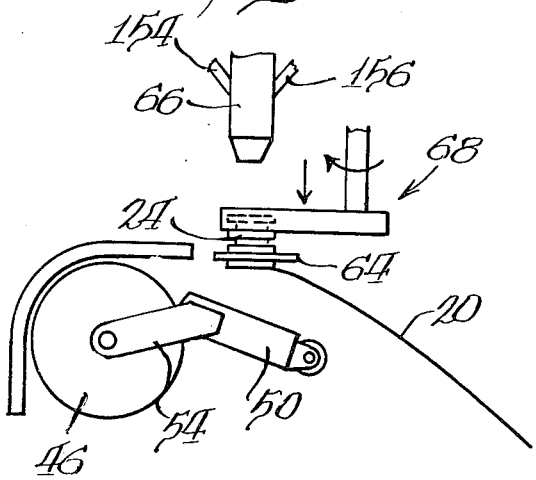

As shown in FIG. 10, the table 50 next is lowered to its downward position, and the capper assembly is operated to engage the head of the spout cap 28 within the jaws thereof.

Figure 11:
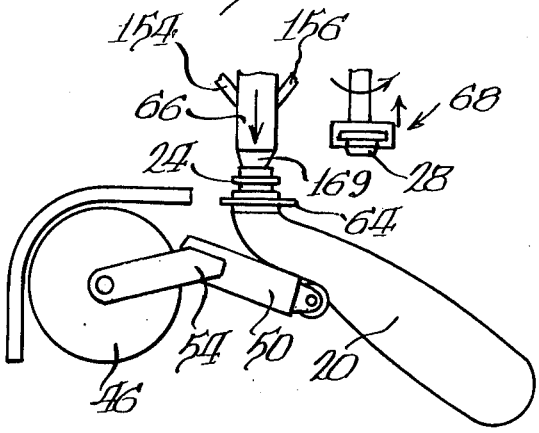

Then, as illustrated in FIG. 11, the capper assembly is elevated to separate the cap from the spout, and rotated to its position remote therefrom. The nozzle is then lowered to engage with the spout about the uncapped opening therein. To form a secure seal with the spout, the nozzle is provided with a tapered portion 169 which terminates in an outlet 171. Optionally, a vacuum may be drawn through the nozzle from the line 154 to void the bag of any atmosphere therein, whereafter product is provided through the nozzle from the line 156 for filling the bag through the spout.

Figure 12:
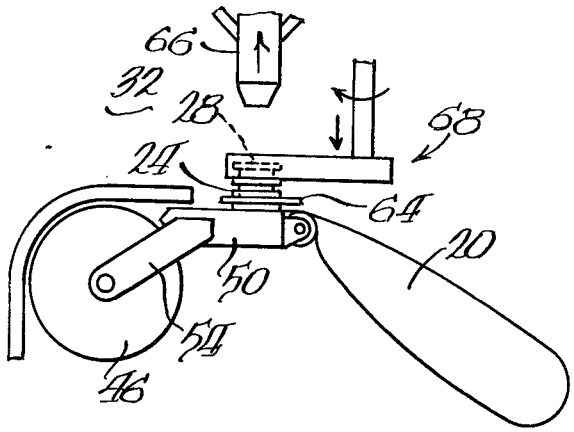

After a predetermined volume of product has been introduced into the bag as shown in FIG. 12, the table 50 is elevated to cause the lower wall of the bag to seal off the spout, after which the nozzle is retracted to its upper position. If desired, a vacuum may be drawn after the bag is filled and before the table 50 is raised to seal off the spout. In any event, the spout and the bag are sealed closed by the table 50 to prevent entry of atmosphere and/or contaminants into the filled bag. The capper assembly is then rotated to its position above the spout and lowered to reinsert the cap into the spout.

Figure 13:
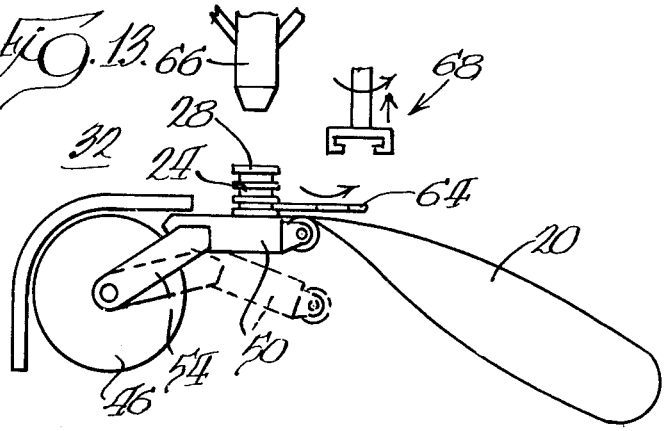

Filling and capping of the bag having been completed, the capper assembly 68 is moved away from the spout and the spout holder 64 is rotated out of the way, as shown in FIG. 13, whereby the filled bag is free to move from the filling station either down the rollers 62 under the urging of its own weight, or by operation of the intermittently operated conveyor. In either case, movement of the bag from the filling station pulls the next succeeding empty bag to the station during which time the spout holder again is rotated back to the position to intercept the upcoming spout. When the spout of the empty bag is engaged by the spout holder, the line 22 of demarcation between the filled and unfilled bags is positioned at the separating station 158, and the severing bar 160 is moved downwardly to sever or separate the bags along the line. The previously filled bag may then be packaged in a container or otherwise removed, and filling of the bag newly positioned at the filling station proceeds as illustrated in FIGS. 9 through 13.

Figure 14:
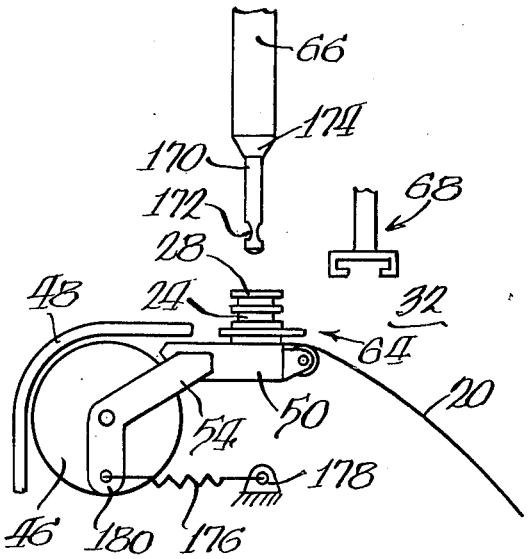
FIGS. 14 and 15 are similar to FIGS. 9 and 11, respectively, and illustrate the mechanisms at the filling station in effecting filling of a container in accordance with another embodiment of the invention.

In accordance with another embodiment of the invention, which eliminates the cylinders for operating the table 50, the nozzle itself moves the table away from the spout to open the connection between the spout and the bag to enable filling of the bag. This is accomplished, as shown in FIG. 14, by providing a nozzle extension 170, of a diameter to pass sealingly through the uncapped opening in the spout 24, having a plurality of outlet passages 172 formed therein toward the lower end thereof. In place of the cylinders 60 for rotating the table or pressure plate 50 between its upper and lower positions, the table is instead normally urged counterclockwise (as shown in the drawings) to its upper position by a spring 176 in tension between a post 178 and a link arm 180 connected with the arm 54.

Figure 15:
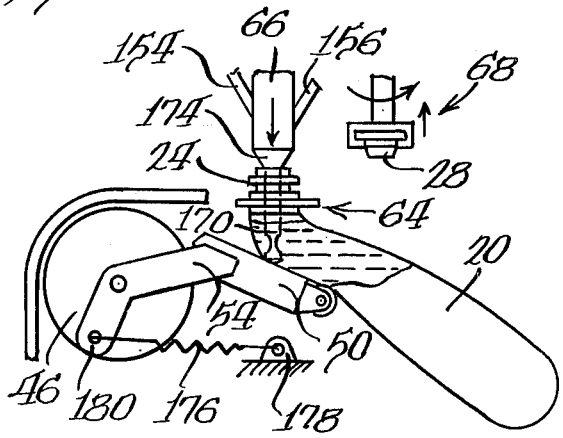

As illustrated in FIG. 15, after removal of the cap 28 from the spout and movement of the capper assembly to its position remote therefrom, the nozzle extension is moved downward through the uncapped opening in the spout into engagement with the table or pressure plate to move the same away from the spout against the urging of the spring 176. This opens a passage into the bag and filling of the bag with product then proceeds substantially as above described.

After the bag is filled, the nozzle is moved upwardly, whereupon the table or pressure plate 50 also moves upwardly under the urging of the spring, thereby causing the lower wall of the bag to seal off the opening between the spout and bag, whereafter the spout is recapped. Subsequent stages of operation then proceed as previously described.

Figure 16:
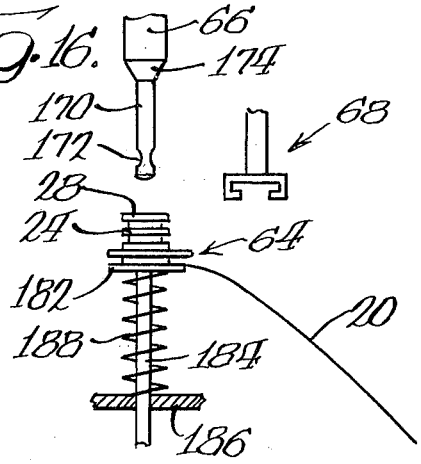
FIGS. 16–18 are similar to FIGS. 9, 11 and 12, respectively, and illustrate the mechanisms at the filling station in effecting filling of a container in accordance with a further embodiment of the invention.
Figure 17:
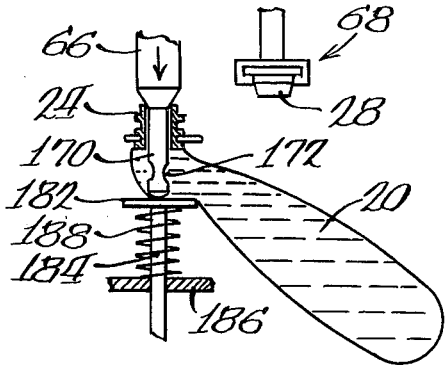
Figure 18:
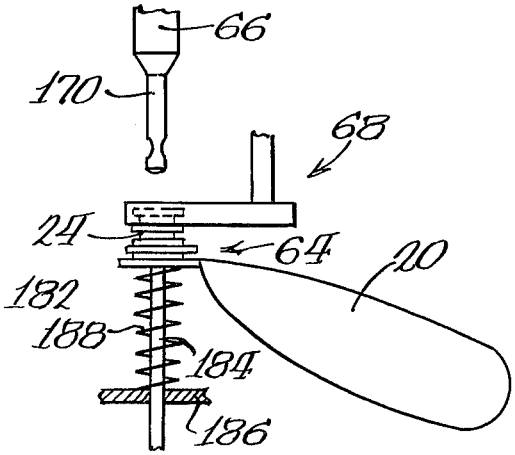

FIGS. 16 through 18 illustrate another arrangement of a spring loaded table or pressure plate which similarly advantageously eliminates the cylinders 60 and functions in substantially the same manner as the structure shown in FIGS. 14 and 15. In this case, a table or platform 182 is mounted for vertical movement with a post 184 slidably extended through a base 186, and is urged upward by a spring 188 in compression between the table and the base. Except for the mounting of the table for vertical instead of rotational movement, the operation of the structure is essentially the same as described for the embodiment of FIGS. 14–15.

The invention thus provides unique apparatus and methods for filling plastic bags. The apparatus is capable of automatic control for efficiently, rapidly and economically filling large numbers of bags in minimum periods of time with minimal supervision. By virtue of the bags being connected, upon each succeeding bag being filled at the filling station, a succeeding empty bag automatically is pulled thereto and the filled bag is severed therefrom. In consequence, the need for operator intervention is minimized, and personnel attention generally is required only to replenish the supply of containers when the same are exhausted. Also, due to the operation of the movable table or pressure plate 50 or 182, any possible contamination of the product in the bag is minimized.

While certain embodiments of the invention have been described in detail, it is understood that various modifications and other embodiments thereof may be devised by one skilled in the art without departing from the spirit and the scope of the invention, as defined by the claims.

What is claimed is:

1. In an apparatus for filling flexible containers connected in continuous web form, each container having a spout communicating therewith adapted to be closed by a separable cap, means for incrementally advancing said containers seriatim to a filling station, filling means at said filling station for sequentially filling each container through the opening in its spout, and means for placing a cap on the spout to close the filled container, said advancing means then advancing the filled container from the filling station to move a succeeding empty container thereto.

2. In an apparatus as set forth in claim 1, said filling means including means for releasably holding each spout while the respective bag is filled and capped.

3. In an apparatus as set forth in claim 1, said filling means including means for removing gases from the respective container through the spout before filling the container.

4. In an apparatus as set forth in claim 1, said filling means including means for excluding the entry of foreign matter into each container through the spout after filling the container and until the cap is applied.

5. In an apparatus as set forth in claim 1, said means for incrementally advancing said containers including an intermittently operated conveyor for moving filled containers.

6. In an apparatus for filling flexible containers connected in continuous web form, each container having a spout communicating therewith adapted to be closed by a separable cap, means for incrementally advancing said containers seriatim to a filling station, filling means at said filling station for sequentially filling each container through the opening in its spout, and means for placing a cap on the spout to close the filled container, said filling means including means for excluding the entry of foreign matter into each container through the spout after filling the container and before applying the cap, said means for excluding foreign matter including means for moving a portion of the container toward the spout to engage about and seal off the spout.

7. In an apparatus for filling flexible containers connected in continuous web form, each container having a spout communicating therewith adapted to be closed by a separable cap, means for incrementally advancing said containers seriatim to a filling station, filling means at said filling station for sequentially filling each container through the opening in its spout, means for placing a cap on the spout to close the filled container, and means for severing each successively filled and capped container from the succeeding connected web of containers.

8. In an apparatus for filling flexible containers connected in continuous web form, each container having a spout communicating therewith adapted to be closed by a separable cap, means for incrementally advancing said containers seriatim to a filling station, filling means at said filling station for sequentially filling each container through the opening in its spout, and means for placing a cap on the spout to close the filled container, said filling means including means for releasably holding each spout while the respective bag is filled and capped, said means for incrementally advancing said containers including a downwardly sloping trackway for supporting filled containers, whereby upon release of the spout of a given container by said holding means the weight of a filled container moves said container down said trackway and pulls the succeeding empty container to said filling station.

9. In an apparatus for filling flexible containers connected in continuous web form, each container having a spout communicating therewith adapted to be closed by a separable cap, means for incrementally advancing said containers seriatim to a filling station; a spout holder at said filling station for releasably holding the spout of a container advanced thereto, a filling nozzle connectable with said spout for filling said container with contents through said spout, and a capping mechanism at said filling station for applying a cap to the spout of the filled container, said spout holder thereupon releasing said spout and said advancing means then advancing said containers to move the filled container from said filling station and to move a succeeding empty container thereto.

10. Apparatus for filling flexible containers as set forth in claim 9, including means at said filling station for manipulating the container after it is filled and before it is capped to exclude entry of foreign matter through the spout before the spout is capped.

11. In an apparatus for filling flexible containers as set forth in claim 10, said manipulating means including a pressure plate at said filling station, and means for moving said plate against said container for moving an internal wall of the container toward the spout to seal off the spout before the filling nozzle is fully withdrawn from the spout.

12. In an apparatus for filling flexible containers as set forth in claim 9, including means for separating each successively filled container from the succeeding web of containers after advancement of a succeeding empty container to said filling station.

13. In an apparatus for filling flexible containers as set forth in claim 9, said means for incrementally advancing said containers including a conveyor for supporting at least one filled container and means for intermittently operating said conveyor.

14. In an apparatus for filling flexible containers as set forth in claim 9, said means for incrementally advancing said containers including a downwardly sloping trackway for supporting at least one filled container, the weight of said container, upon release of said spout holder, moving said container down said trackway and pulling a succeeding empty container to said filling station.

15. Apparatus for filling flexible containers having a filling aperture adapted to be closed by a separable cap, comprising container filling means engagable with the container aperture, a pressure plate for supporting the container under the filling means, said plate being movable toward and away from the filling means, and means operable upon completion of a filling cycle for moving said plate toward said filling means for causing an internal wall of the container to engage about and seal off said aperture thereby to exclude entry of foreign matter into the container until the aperture is closed by a cap.

16. Apparatus as set forth in claim 15 wherein said pressure plate is yieldably biased toward said filling means and said means for moving said plate comprises a container filling nozzle associated with said filling means; and means for moving said nozzle through the container aperture and into the interior of the container and for thereby moving said pressure plate to accommodate filling of the container, and for withdrawing said nozzle from the container thereby to cause the pressure plate to seal off the aperture as the nozzle is being withdrawn from the aperture.

17. Apparatus as set forth in claim 15, wherein said filling means includes a nozzle insertable in the container aperture, said plate being moved toward said filling means while said nozzle is still inserted in the aperture.

18. A method of filling containers each having a filling aperture therein adapted to be closed by a closure, comprising the steps of providing a plurality of containers connected together seriatim in a continuous row; moving the row of containers to move the containers seriatim to a filling station; and at the filling station, filling the respective container with contents through the aperture therein, and placing the closure on the container to close the aperture therein.

19. A method as set forth in claim 18, including the step of moving the row of containers by intermittently moving at least one filled container, thereby to sequentially pull the unfilled containers to said filling station.

20. A method as set forth in claim 19, including the step of separating each filled container from the succeeding containers in the row after the respective filled container has performed its function of moving the row of containers.

21. A method as set forth in claim 18, including the step of moving the row of containers by gravitational movement of at least one filled container, thereby to advance succeeding unfilled containers to said filling station.

22. A method as set forth in claim 18 including, just prior to the filling step, the step of drawing through said aperture any gases in the respective container.

23. A method as set forth in claim 18, wherein the containers are flexible collapsible bags connected together in end to end relationship in a continuous web.

24. A method of filling containers each having a filling aperture therein adapted to be closed by a closure, comprising the steps of providing a plurality of containers connected together seriatim in a continuous row; moving the row of containers to move the containers seriatim to a filling station; and at the filling station, filling the respective container with contents through the aperture therein, and placing the closure on the container to close the aperture therein; and after said filling step and prior to said closure placing step, manipulating the filled container to exclude entry into the container of any foreign substance.

25. A method as set forth in claim 24, said manipulating step including moving a portion of the container into engagement with the portions thereof surrounding said aperture to seal off said aperture.

26. A method of filling containers each having a spout communicating therewith adapted to be closed at its outer open end by a separable cap, comprising the steps of providing a plurality of containers connected together seriatim in a continuous row; moving the row of containers intermittently to advance the containers seriatim to a filling station; and at said filling station, holding the spout on each container with said outer end thereof substantially upright, introducing contents through the outer end of the spout to fill the respective container, placing the cap on the spout to close the same, and releasing the spout.

27. A method as set forth in claim 26, said advancing step including the steps of carrying at least one filled container on a conveyor, and intermittently operating said conveyor after the spout on the container at said filling station has been released, thereby to advance the next successive unfilled container to said filling station.

28. A method as set forth in claim 26, said advancing step including the step of supporting at least one filled container on a downward sloping trackway whereby, after the spout on the container at said filling station has been released, said filled container is freed for gravitational movement to pull the next succeeding unfilled container to said filling station.

29. A method as set forth in claim 26, including the steps of causing at least one filled container to move the row of containers by an increment equal to the length of one container thereby to advance the next succeeding unfilled container to said filling station, and thereafter severing said one filled container from the row of containers.

30. A method of filling containers each having a spout communicating therewith adapted to be closed at its outer open end by a separable cap, comprising the steps of providing a plurality of containers connected together seriatim in a continuous row; moving the row of containers intermittently to advance the containers seriatim to a filling station; and at said filling station, holding the spout on each container with said outer end thereof substantially upright, introducing contents through the outer end of the spout to fill the respective container, placing the cap on the spout to close the same, and releasing the spout, and between said introducing and placing steps, manipulating the respective container to exclude entry of gases through the spout.

31. A method as set forth in claim 30, said manipulating step including the step of moving an internal wall of the container into overlying relationship relative to the inner end of the spout to seal off the spout.

32. A method of filling containers each having a spout communicating therewith adapted to be closed at its outer open end by a separable cap, comprising the steps of providing a plurality of containers connected together seriatim in a continuous row; moving the row of containers intermittently to advance the containers seriatim to a filling station; and at said filling station, holding the spout on each container with said outer end thereof substantially upright, introducing contents through the outer end of the spout to fill the respective container, placing the cap on the spout to close the same, and releasing the spout; causing at least one filled container to move the row of containers by an increment equal to the length of one container thereby to advance the next succeeding unfilled container to said filling station, guiding the spout of each successive container to a spout holding means at the filling station and causing said holding means to engage the spout and thereby arrest the movement of the row of containers, and thereafter severing said one filled container from the row of containers.

33. A method of filling flexible collapsible bags having a filling spout thereon adapted to be closed by a cap, comprising the steps of inserting a filling nozzle into the spout and introducing contents into the bag to fill the bag, moving an internal wall of the bag into overlying relationship relative to the inner end of the spout to seal off the spout and exclude entry of foreign matter, and thereafer removing the filling nozzle from the spout and applying a cap to the outer end of the spout.

* * * * *